United States Patent [19]

Banker

[11] 4,021,587

[45] May 3, 1977

[54] MAGNETIC AND ELECTROSTATIC TRANSFER OF PARTICULATE DEVELOPER

[75] Inventor: Harold J. Banker, Bethel Park, Pa.

[73] Assignee: Pram, Inc., Wilmerding, Pa.

[22] Filed: Feb. 12, 1976

[21] Appl. No.: 657,606

Related U.S. Application Data

[62] Division of Ser. No. 490,969, July 23, 1974, Pat. No. 3,939,800.

[52] U.S. Cl. ..... 427/18; 141/DIG. 1

[51] Int. Cl.[2] ..... B05D 1/06

[58] Field of Search ..... 427/18, 25, 30, 47, 427/48; 118/621, 623, 626, 636, 637; 141/DIG. 1; 222/DIG. 1, 372; 346/74 ES; 101/DIG. 13; 355/3 DD

[56] References Cited

UNITED STATES PATENTS

| | | | |
|---|---|---|---|
| 2,890,968 | 6/1959 | Giaimo, Jr. | 427/18 |
| 2,892,446 | 6/1959 | Olden | 427/18 X |
| 2,930,351 | 3/1960 | Giaimo, Jr. | 427/18 X |
| 2,984,163 | 5/1961 | Giaimo, Jr. | 118/637 X |
| 3,681,138 | 8/1972 | Ankenbrand et al. | 427/48 |
| 3,717,122 | 2/1973 | Hudson | 427/18 |

*Primary Examiner*—Morris Kaplan
*Attorney, Agent, or Firm*—Fred C. Trenor

[57] ABSTRACT

An apparatus for depositing electrostatically and magnetically responsive particulate matter on a conductive surface having an electrostatically charged latent image comprises an elongate permanent magnet that is disposed adjacent to the conductive surface and that is capable of producing a magnetic field having a region of concentrated magnetic flux that permeates the surface and also a region of dilute magnetic flux that is inclined and generally adjacent to the surface, a hopper for storing the particulate matter, and a channel connected to the hopper disposed in the region of dilute magnetic flux having two opposite converging walls that terminate adjacent to the conductive surface in the region of concentrated magnetic flux. The particulate matter when introduced to the region of dilute magnetic flux is caused to be moved by magnetic forces and gravitational forces from the region of dilute magnetic flux to the region of concentrated magnetic flux. The particulate matter is deposited on the surface by the electrostatic forces overcoming the magnetic forces in the region of concentrated magnetic flux. The application also discloses a process for depositing particulate matter on a moving conductive surface by producing a magnetic field having a region of concentrated magnetic flux that permeates the surface and a region of dilute magnetic flux that is inclined and generally adjacent to the surface, introducing a quantity of the particulate matter to the region of dilute magnetic flux, and then placing the conductive surface into the region of concentrated magnetic flux whereby the particulate matter is caused to move from the region of dilute magnetic flux to the region of concentrated magnetic flux by magnetic forces and gravitational forces and thence to the conductive surface by overwhelming electrostatic forces.

4 Claims, 5 Drawing Figures

MAGNETIC AND ELECTROSTATIC TRANSFER OF PARTICULATE DEVELOPER

This is a division of application Ser. No. 490,969, filed July, 23, 1974, now U.S. Pat. No. 3,939,800.

BACKGROUND OF THE INVENTION

A. Field of the Invention

This invention relates to a process for use in electrostatic copying machines, and more particularly, to a process for depositing electrostatically and magnetically responsive particulate matter on a moving photoconductive surface bearing a latent electrostatic image.

B. Discription of the Prior Art

In typical electrostatic photocopying processes a surface of a photoconductive insulating material is charged with a uniform electrostatic charge. The charged surface of the photoconductive material is then exposed to a light image through a photographic transparency or some other suitable means. The portions of the charged surface that are irradiated by light are discharged while the remaining portions of the charged surface maintain their charge to form a latent electrostatic image that corresponds to the light image. The latent electrostatic image on the surface is developed by applying electrostatically responsive powder to the surface. The powder image thus formed is fixed directly to the photoconductive surface by fusing or the like.

More recently, magnetic forces and electrostatic forces have been used to develop latent electrostatic images in electrostatic photocopying machines. In some instances, the developer powder is applied to the conductive surface by using the well known "magnetic brush" technique. The developer powders that have been employed are well known in the art and generally comprise dyed or colored pigmented thermoplastic powders referred to as "toner" that are mixed with more course particles known as "carriers", such as, for example, iron filings. Developer powders can be formulated so that the toner carries a negative or positive charge. A typical positive developer powder is formulated from carbon black pigmented, polystyrene resin toner mixed with iron magnetites or ferrites. In any case, the toner and the carrier are selected so that the toner particle acquires the proper charge with respect to the latent electrostatic image. When the "developer brush" is brought into contact with the conductive surface greater attractive electrostatic forces of the charged image cause the toner particles to leave the carrier particles and adhere to the conductive surface.

Apparatus for using the magnetic brush technique are well known in the art. Typically a magnetic brush consists of a non-magnetic rotatably mounted cylinder having magnets fixed inside the cylinder. The cylinder is adapted to rotate with a portion of its surface immersed in a hopper having a supply of developer powder. The developer powder, being a mixture of iron carrier particles and electrostatic toner particles, is magnetically attracted to the surface of the cylinder to form a brush-type arrangement thereon as a result of the magnetic flux developed by the magnets. The bristles of the brush conform to the lines of magnetic flux. The conductive surface such as, for example, a sheet of paper bearing a latent electrostatic image is brought into physical contact with the brush and toner is thereupon deposited on the sheet of paper.

The rotating cylinder continues to attract developer powder and returns part or all of this material to the hopper within one revolution. Accordingly, a fresh mix is always available to the copy sheet surface at its point of contact with the brush.

In every instance the systems and apparatuses of the prior art require a delicate balance between the ratio of iron carrier particles and the electrostatic toner particles as well as an intimate admixture of uniform quality. Quite often variations in the ratio of the inro carrier particles to the electrostatic toner particles in experienced resulting in poor coverage of the image to be developed. Furthermore, the iron carrier particles gradually deteriorate and frequently the entire system must be cleaned and replaced with a fresh admixture of carrier and toner.

It is well recognized that the step of developing the latent electrostatic image is perhaps the most critical step in all of the process steps of electrostatic copying. The final print quality can be no better than the quality of development step. Recently significant improvements have developed in the method of image developing, and particularly, a new developer powder has been developed as shown for example in U.S. Pat. No. 3,639,245 involving a composite developer powder comprising magnetizable particles embedded in the toner particles. The composite developer powder of the above mentioned patent is used with the prior art apparatuses such as, for example, the brush-type applicators that use the rotating cylinder to carry the developer powder from its supply to the conductive surface.

Despite this improvement in developer powders there is still a need for improvements in the devices employing such powders. For example, the cylinder being journalled to a shaft for rotation developes considerable misalignment between the cylinder and the conductive surface resulting in a poor nonuniform deposition of developer powders to the surface. Such failures result in customer complaints and considerable expense in replacing the cylinders and the like. Furthermore, the prior art devices are complex; a need for simplifying the structures utilizing the brush-type technique and to obtain savings in the cost of manufacture of such devices without sacrificing performance dependability are needed.

Accordingly, I have developed a process that substantially eliminates the number of moving parts and particularly, the necessity for rotating cylinder of the prior art devices. My device and process being of a less complicated structure is considerably less expensive to manufacture than the prior art devices. My apparatus and process using the improved magnetically and electrostactically responsive developer powders is capable of developing latent electrostatic images of greater clarity and resolution than the prior art devices.

SUMMARY OF THE INVENTION

In accordance with my invention, my apparatus for depositing electrostatically and magnetically responsive particulate matter on a conductive surface bearing a latent image comprises a magnetic field producing means disposed adjacent to the conductive surface that is capable of producing a magnetic field having a region of concentrated magnetic flux and a region of dilute magnetic flux that is inclined and generally adjacent to the surface, storage means for storing the particulate matter and channel means adapted for use with the storage means and disposed adjacent to the surface in the region of dilute magnetic flux that is capable of channelling a quantity of the particulate matter from the storage means to the region of concentrated magnetic flux whereby the gravitational forces and magnetic forces in the region of dilute magnetic flux move the quantity of particulate matter from the storage means to the region of concentrated magnetic flux and the electrostatic forces cause the quantity of particulate matter to be deposited on the conductive surface.

In a preferred embodiment of my invention my process includes an electric field producing means disposed adjacent to the magnetic field producing means and the conductive surface that is capable of producing an electric field at the region of concentrated magnetic flux and that is capable of imparting an electric charge to the particulate matter.

In accordance with the process of my invention a magnetic field is produced having the region of concentrated magnetic flux and the region of dilute magnetic flux, a quantity of the particulate matter is introduced to the region of dilute magnetic flux, and the conductive surface is placed into the region of concentrated magnetic flux whereby the particulate matter is caused to move from the regions of dilute and concentrated magnetic flux by forces of magnetism to the conductive surface by electrostatic forces.

DETAILED DESCRIPTION OF THE DRAWINGS

DETAILED DESCRIPTION

Figure 1:
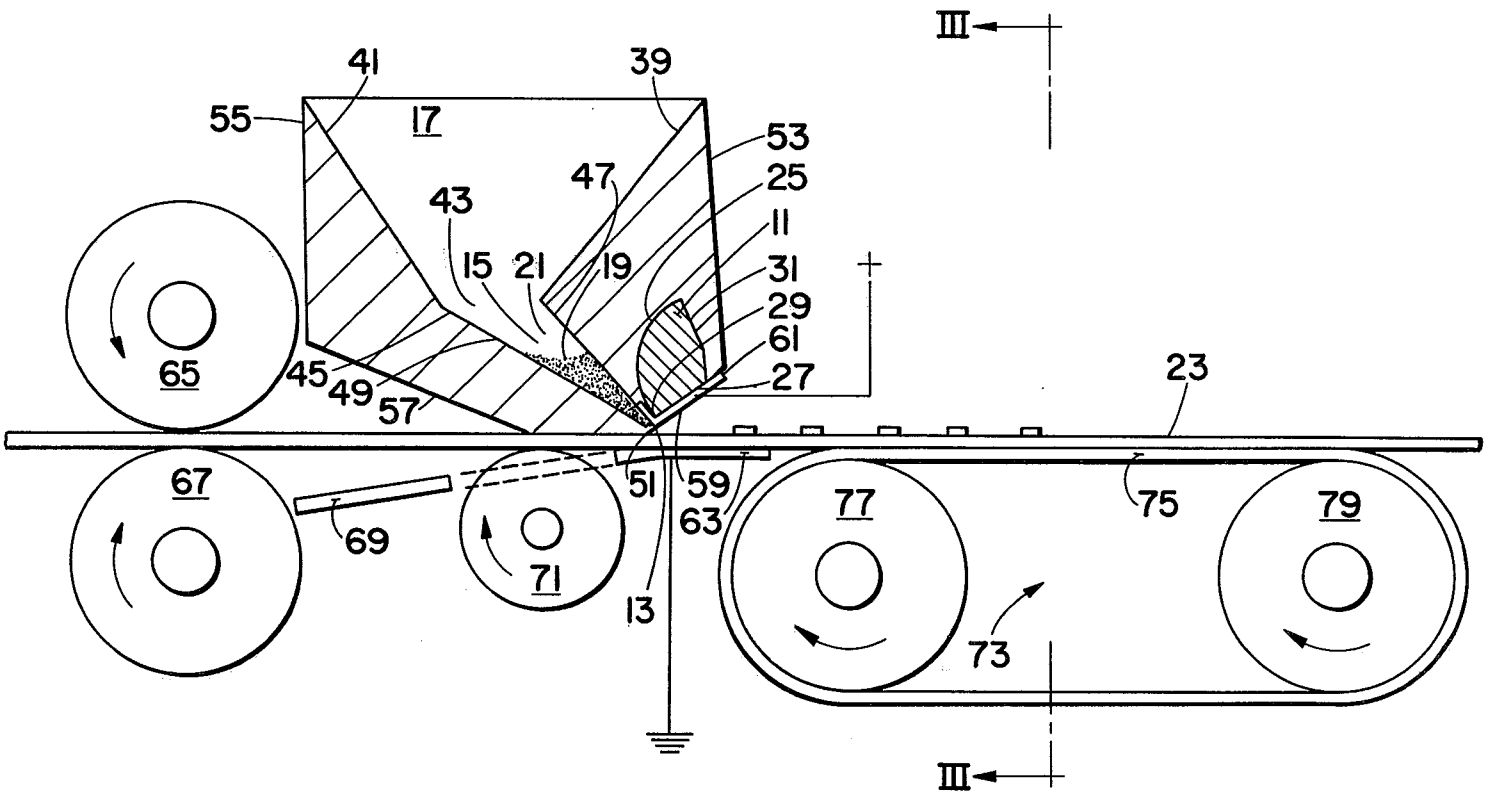
FIG. 1 is a side view in elevation illustrating a preferred embodiment of the invention.

In FIG. 1 there is illustrated an elongate permanent magnet 11 producing a region of concentrated magnetic flux generally indicated at 13 (although the lines of magnetic flux are not illustrated in FIG. 1) and a region of dilute magnetic flux generally indicated at 15 (although the lines of magnetic flux are not illustrated in FIG. 1), a storage hopper generally indicated at 17 that contains particulate matter 19, and a channel 21 that is capable of channelling the particulate matter 19 from the storage hopper 17 through the region of dilute magnetic flux 15 to the region of concentrated magnetic flux 13. Suspended beneath the hopper 17 is a conductive surface 23.

Figure 4:
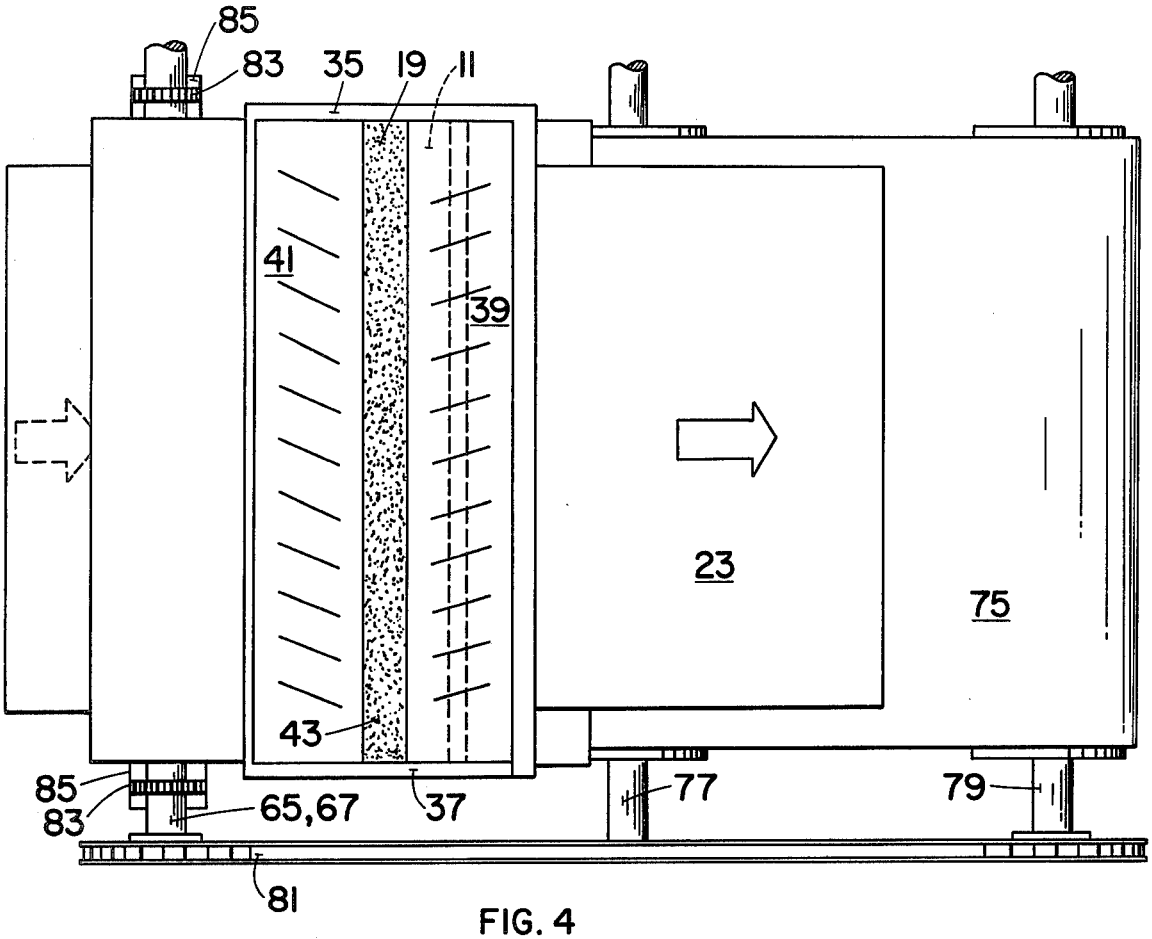
FIG. 4 is a plan view of the device of FIG. 1.

As more clearly illustrated in FIG. 4 the permanent magnet 11 is elongate and extends entirely across the hopper 17 and transversely across and beyond the conductive surface 23. In the embodiment of FIG. 1, the permanent magnet 11 has a generally quarter-spherical cross-sectional configuration and comprises an arcuate face 25 facing towards the particulate matter 19 and storage hopper 17, a first planer face 27 extending from one end of the arcuate face 25 from a point 29 and a second planar face 31 extending from the other end of the arcuate face to the first planar face 27. The permanent magnet 11 is oriented with respect to the hopper 17 the particulate matter 19 contained therein and surface 23 so that the point 29 from which the region of concentrated magnetic flux emanates is facing the conductive surface 23 and the region of dilute magnetic flux extends towards the hopper 17.

The elongate magnet is carried by the structure of the hopper 17 and is integral therewith as will be more fully explained. If desired, the permanent magnet need not be integral with the hopper but may comprise a separate component and either be appropriately suspended above the surface or fixed to a side wall of the hopper (not illustrated).

The elongate magnet is carried to the right of the slit 51 in the drawings but it could also be carried to the left of the slit 51 with appropriate design changes in the hopper 17 and trough 45 in accordance with my invention.

The permanent magnet 11 is composed of a non-magnetic matrix which may be a resinous or plastic composition, an elastomeric semi-solid or a viscous liquid that is capable of hardening, setting or being cured to a solid state in which there is evenly dispersed anisotropic ferrite domain-sized particles that are capable of achieving a physical orientation when acted upon by internal sheer stresses. The example of such particles are certain fine-grain permanent magnet materials, particularly the ferrites of barium, lead and strontium that are easily magnetized to saturation. The non-magnetic matrix may also be composed of natural rubber with compound agents, plasticizers, vulcanizing agents and the like to provide the hardness of the matrix desired, or may be thermoplastic or thermosetting materials, such as for example, polyvinyl chloride. Such magnets may be formed by extrusion and manners well known in the art.

Alternatively, rather than using permanent magnets, electromagnetic devices may be used in accordance with the invention.

The elongate magnet 11 as illustrated in the drawings comprises a single member, however, the permanent magnet may comprise a plurality of members, all of which must possess the same orientation of polarity across its entire length so that uniform fields of magnetic flux extend across the length of the elongate magnet and permeate the surface 23.

Figure 5:
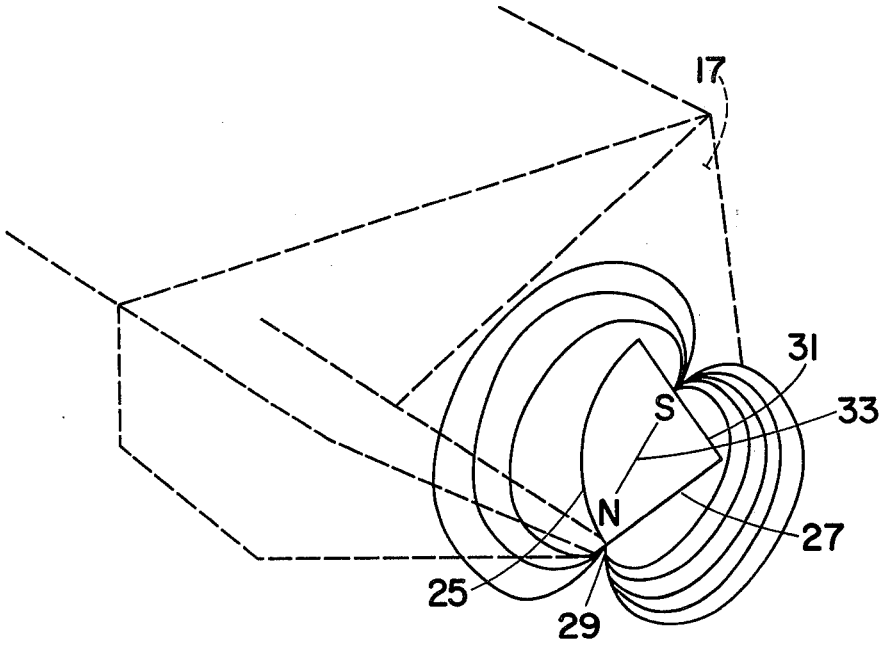
FIG. 5 is an isolated view of the preferred embodiment of the magnet used in accordance with the invention illustrating the lines of magnetic flux.

FIG. 5 illustrates the lines of magnetic flux emanating from the pole surfaces of the magnet. As illustrated, the north pole of the magnet exists at point 29 and the south pole exists at the second planar face 31, although the polarity of the magnet could be reversed. Lines of magnetic flux emanate from the point 29 and pass through the air, through a portion of the hopper 17 to return to the second planar surface 31 at the south pole. The lines of magnetic flux are distorted and asymmetrical. There is a greater concentration of magnetic flux on the west side of the north-south magnetic line 33 away from the hopper 17, than on the east side of the north-south magnetic line 33 towards the hopper FIG. 5. The distorted and asymmetrical nature of the magnetic flux of the magnet in FIG. 5 is a desirable feature of my invention in that a longer magnetic distance is provided between the poles on the east side of the north-south magnetic line and a shorter magnetic distance is provided on the other opposite west side of the north-south magnetic line. This distortion results in a magnet having a lower gauss level and a wider array of flux travel around the east side of the magnet than the west side of the magnet. The magnet being oriented with respect to the hopper 17 and the conductive surface 23 presents magnetic flux of the lower gauss level facing the hopper 17 as illustrated in FIGS. 1 and 5. Consequently, there will not be any magnetic attraction of particulate matter 19 on the side walls of the hopper 17, and there will not be any magnetic attraction until the particulate matter is in close proximity to the region of dilute magnetic flux.

The cross-sectional configuration of the magnet illustrated in the drawings is not particularly critical, although as previously explained, the orientation of the magnetic flux with respect to the hopper and conductive surfaces is critical. Any cross-sectional configuration that develops a distorted and asymmetrical magnetic flux with the magnetic flux having the lower gauss level being oriented towards the hopper 17 will be satisfactory. Alternatively, a magnet providing a uniform magnetic flux such as for example, a magnet having a square or circular cross-sectional configuration may be employed, however, such magnets will require appropriate magnetic shielding to reduce the magnetic flux emanating from the magnet in the area facing the hopper 17. The disadvantage of employing magnetic shielding is that such designs are complicated, expensive and may well tend to restrict the design of the interior walls of the hopper as magnetic shielding does not actually block magnetic flux but simply attenuates the flux to a point where it will not cause an attraction of the particulate matter to the side walls of the hopper 17.

The magnets employed in accordance with the preferred embodiment of the invention contemplate a gauss level of about 120 measured directly at the pole surface. A magnetic strength of 120 gauss is adequate for my invention, however, it will be recognized that the actual gauss level required in any embodiment of my invention will be dictated in great measure by the configuration and dimensions of the hopper and location of the magnet so as to provide a sufficient quantity of particulate matter for development in accordane with the invention.

Figure 2:
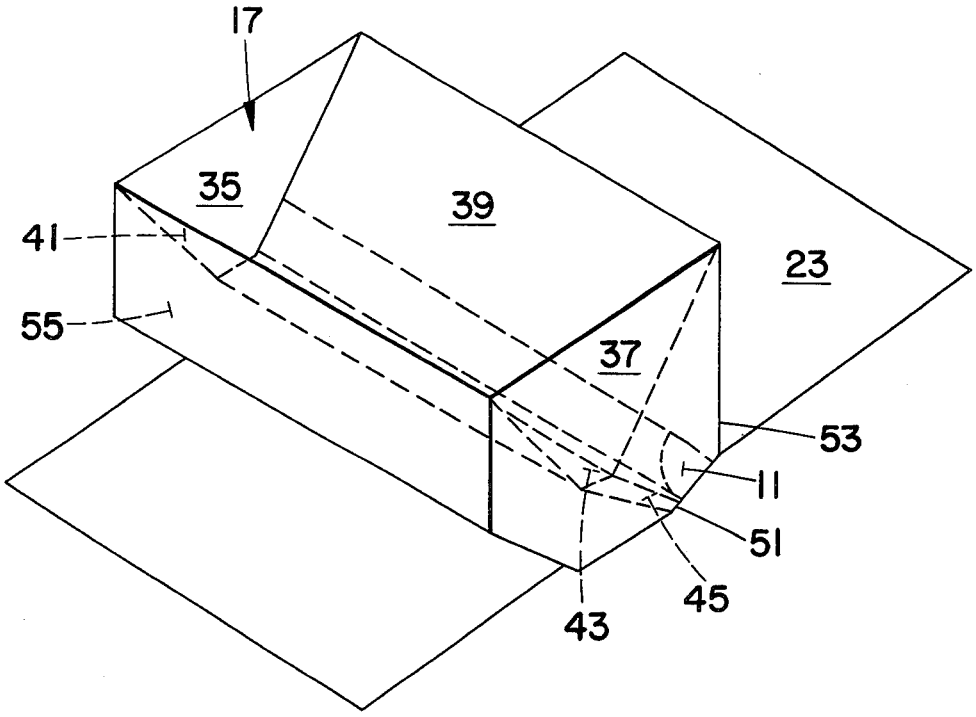
FIG. 2 is a prospective view more clearly illustrating the preferred embodiment of the invention.
Figure 3:
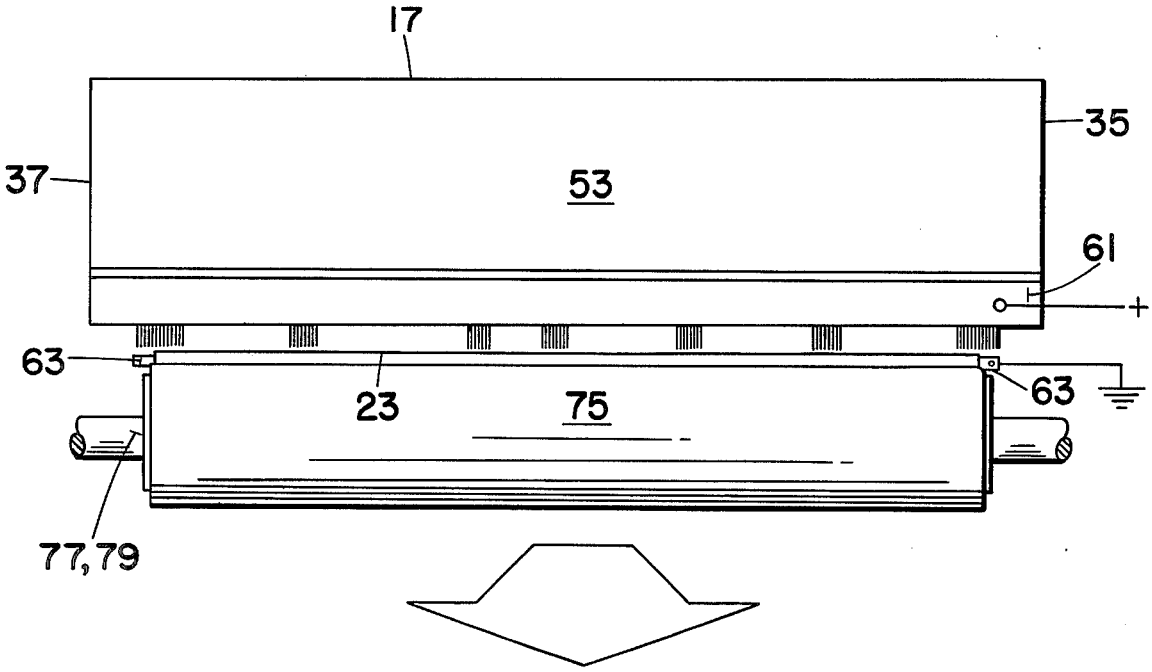
FIG. 3 is a front view in elevation of the device of FIG. 1 at line 3—3.

In the drawings hopper 17 comprises two oppositely facing in end walls 35 and 37 that are generally vertically disposed in the drawings, oppositely facing side walls 39 and 41 to provide a generally rectangular configuration as viewed from the plan view of the device at FIG. 4. The side walls 39 and 41 of the hopper 17 converge towards each other as illustrated in FIGS. 1 and 2 to provide an elongate opening or slit 43. The opening 43 enters into a channel or trough 45. Trough 45 comprises two converging faces, a leading face 49 and a trailing face 47 that converge to form a trough opening or slit 51 that is disposed adjacent to surface 23 in the region of concentrated magnetic flux 13 as illustrated in FIG. 1.

The trough opening 51 extends across the entire length of the hopper 17 as well as across the width of the conductive surface 23 so that a uniform deposition of particulate matter 19 may be provided on the conductive surface 23.

The trough 45 illustrated in the drawings is generally inclined to and must have its leading face or wall 49 inclined to the conductive surface 23 at an angle. The trough itself is positioned so as to lie within the region of dilute magnetic flux. I have found that the leading wall 49 must be inclined to the conductive surface 23 at an angle not less than 26°, especially in the region of dilute magnetic flux. If the angle is less than 26° the particulate matter will tend to clog and poor deposition of particulate matter will occur. The angle of inclination is designed in accordance with the flow properties of the particulate matter used. It should be recognized that the trough is inclined to the left in FIG. 1 but it could be reversed and inclined to the right if desired. In such case the trailing wall would have to be inclined at an angle not less than 26°.

The particulate matter will move from the hopper 17 through the trough 45 by the forces of gravity and the magnetic forces generated by the region of dilute magnetic flux. The trough opening 51 will have a width that will be determined by the flux density of the magnetic field employed and the magnetic permeability of the particulate matter employed. I have found that the region of the dilute magnetic flux should range from 90 to 95 gauss and in such instances, I have discovered that the trough opening should be within at least one quarter of an inch in distance from the magnetic pole of the magnet on the point 29 where the region of maximum flux density occurs and that the trough opening must have a width not in excess of three eights of an inch. A wider trough opening would cause a portion of the particulate matter to fall from the hopper to the trough solely by the forces of gravity thereby forming lumps of particulate matter on the conductive surface as well as depositing particulate matter on the unexposed regions of the conductive surface.

The hopper 17 further comprises exterior side walls 53 and 55 that are generally parallel to each other and are essential perpendicular to the conductive surface 23, although their particular orientation is not critical. Further, there is provided exterior bottom walls 57 and 59 meeting the respective exterior side walls 53 and 55 and terminating at the trough opening 51 or slit, as illustrated in FIG. 1. Bottom wall 59 is inclined away from the conductive surface 23 to provide ample clearance for the deposition of particulate matter 19 onto the conductive surface 23. Bottom wall 57 at the region nearest the trough opening 51 is essentially parallel to the conductive surface 23 and in rubbing contact therewith to stabilize and guide the movement of the conductive surface 23 with respect to the trough opening 51.

The hopper may be extruded from such materials as rigid nylon, polyvinyl chloride, polystyrene, acrylonitrile butadiene styrene resins, aluminum and the like. Such materials have electrical conductivity properties that are compatible with the triboelectric properties of the particulate matter so that the particulate matter does not adhere to the walls of the hopper.

I have found that the performance of my device may be significantly improved by the use of an electric field at the region of concentrated magnetic flux 13. In the drawings there is illustrated a conductive strip 61 that extends along the length of the hopper and transversely to the conductive surface 23 and that is adjacent thereto. In the drawings the conductive strip 61 is fixed to bottom wall 59 of hopper 17. On the other side of the conductive surface 23, there is another conductive strip 63, substantially underneath conductive strip 61. Conductive strip 63 is in essentially rubbing contact with the conductive surface 23 and serves as a guide for the conductive surface 23 as it moves with respect to the trough opening 45. Conductive strip 61 is connected to a source of potential and conductive strip 63 is connected to a ground although the respective conductive strips could be connected in reverse order. The conductive strips when energized provide an electric field between them and serve a dual purpose in accordance with the invention. First, the electric field is capable of imparting an electric charge to the particulate material of an opposite polarity to the charge of the latent electrostatic image of the conductive strip 23. Secondly, the electric field is capable of neutralizing any residual electrostatic charges on the conductive strip 23 that are undesirably left on the non-image portions of the surface. Thus the field is capable of "washing" undesirable images from the conductive surface 23 to provide a final copy product of improved resolution and clarity.

The amount of biasing voltage applied to the conductive strip may vary in accordance with my invention. The biasing voltage is determined by several factors including the amount of charge contained on the conductive surface 23, the affinity of the particulate matter to such charge, the distance from the conductive surface 23 to the outer-most surface of the particulate matter being deposited on the conductive surface 23. I have found that a voltage varying from a fraction of a volt for some materials to between 200 and 600 volts for other types of materials such as for example, zinc oxide and resin binder systems, may be used in accordance with the invention.

It is preferred that a smooth direct current (D.C.) be employed by a transformer and appropriate rectifying and filtering equipment that normally operates from a common 115 volt 60 cycle power source. It is to be understood however, that for some applications an alternating current (A.C.) may be preferred over a D.C. field to achieve special results. It is also to be recognized that in some applications a non-filtered D.C. voltage source may be employed in accordance with the invention.

As illustrated in the drawings the electric field produced by the conductive strips 61 and 63 is positioned coincidentally with the region at which the particulate matter is being deposited upon the conductive surface 23. The position of the electric field must exist at this point so that the field may neutralize the undesired residual charges existing on the conductive surface 23.

As previously explained, the particulate matter must possess an electric charge that is opposite in polarity to the charge of the latent electrostatic image on the conductive surface 23. In the devices of the prior art, the particulate matter is charged triboelectrically, or an electric charge must be induced on the particulate matter being contained in the hopper.

In my invention, the particulate matter does not have the opportunity to be charged triboelectrically as compared to the devices of the prior art because of the reduced amount of agitation in my invention. Accordingly, the electric field previously described may be necessary to impose such a charge on the particulate matter. Alternatively, suitable probes and the like mounted within the hopper (not illustrated) may be employed to induce a static charge on the particulate matter.

In FIG. 1 the conductive surface 23 comprises a sheet of paper that is esentially a photoconductive surface having thereon a coating of zinc oxide with a resin binder. In operation a latent image is formed on the photoconductive surface by first imposing a uniform electrostatic charge onto the surface by any conventional means (not illustrated) and then subjecting the surface to a pattern of light by conventional means (not illustrated) whereby the regions on the photoconductive surface that have been impinged with light will have their electrostatic charge dissipated by the proton energy of the light beam. Areas on the surface not receiving light energy will retain their charge to be later developed with the electrostatically and magnetically responsive particulate matter as previously described.

The paper or photoconductive surface is then drawn through contact rollers 65 and 67 both of which are aligned with respect to each other as illustrated in FIG. 1. In FIG. 1 there is illustrated a guide plate 69 that is used to guide the paper between the guide plate 69 and bottom wall 57 of the hopper. Alternatively, two guide plages one above and one below the paper could be employed instead of using the bottom wall 57 of the hopper, however, in such an instance the configuration of the hopper would have to be modified.

Beneath the paper and between contact rollers 65 and 67 and the guide plate 69 there is an aligning roller 71 used for the purpose of urging the paper against the bottom wall 57 of the hopper to assure a perfectly flat transverse contact of the paper's surface with the region in which the particulate matter is being deposited onto the paper.

Down stream of the region in which particulate matter is being deposited there exists a conveyor means 73 comprising a continuous conveyor belt 75 that is mounted on conveyor rollers 77 and 79 and that is used to pull the sheet of paper through the system. Preferably the conveyor belt 75 extends transversely across the entire width of the sheet of paper to provide a uniform base upon which the paper may be drawn through the system and the conveyor means 73 are coordinated and synchronized in their movement to provide a uniform movement of the sheet of paper through the system. The synchronized movement is accomplished as illustrated in FIG. 5 (but not illustrated in FIG. 1) by the contact roller 67 (the bottom roller in FIG. 1) and the conveyor rollers 77 and 79 being linked together with an appropriately designed cog and chain arrangement 81 connecting all rollers together as shown in FIG. 4. A suitable drive system such as for example, an electric motor, is connected with the cog and chain arrangement of FIG. 4 (not illustrated) to drive the moving parts in synchronization.

Contact rollers 65 and 67 are appropriately linked together by a spring 83 mounted in bushings 85 on both ends as shown in FIG. 4 (but not shown in FIG. 1). This connection provides synchronized movement of both contact rollers 65 and 67 for the uniform movement of the sheet of paper 23 through the system.

In use the elongate magnet 11 produces a magnetic field that has a region of concentrated magnetic flux 13 that permeates the conductive surface 23 and a region of dilute magnetic flux 15 that is inclined and generally adjacent to the surface 23. The region of concentrated magnetic flux emanates from the north pole of the magnet at point 29 that is adjacent to the surface 23. The lines of magnetic flux emanating from the point 29 are substantially perpendicular to the conductive surface 23. Subsequently a quantity of particulate matter 19 is introduced into the regions of magnetic flux by the trough 45 that lies within the region of dilute magnetic flux. A conductive surface is placed into the region of concentrated magnetic flux having thereon a latent electrostatic image developed in a manner well known to the art. Consequently the particulate matter is caused to move from the region of dilute magnetic flux to the region of concentrated magnetic flux by magnetic forces and gravity and thence to the surface by electrostatic forces overcoming the magnetic forces there.

Preferably the conductive strips are biased with a voltage to produce an electric field at the region of concentrated magnetic flux for the purpose of inducing a charge to the particulate matter and for the purpose of neutralizing diffuse unwanted electrostatic charges on the surface to improve the quality and clarity of the deposition of particulate matter onto the surface.

As illustrated in FIG. 4, the conductive surface 23 has a latent electrostatic image in the form of an arrow illustrated in phantom lines on the left of the hopper. As the paper is advanced through the contact rollers underneath the hopper and through the region of concentrated magnetic flux, the particulate matter is deposited onto the conductive surface to develop an image as illustrated by the darkened arrow on the surface 23 as shown in FIG. 4 to the right of the hopper. Subsequently, the image is fixed to the surface in manners well known to those skilled in the art.

While my invention has been described with the hopper being positioned above the conductive surface to develop images on the upper portion of the surface, it will be understood that the hopper could be used to develop images on the underneath portions of the surface by disposing the hopper under the conductive surface 23 and employing various mechanical means to convey the particulate matter to the region of dilute magnetic flux and thence to the surface as above described. Such devices, however, would requre additional equipment and more moving parts.

The advantages of my invention are readily recognizable. My invention minimizes and eliminates the need to rely on multiple mechanical devices to convey and transfer particulate matter from the storage hopper to the region of deposition on the image surface. Several beneficial results are obtained by my invention such as reducing the cost of the apparatus and eliminating the possibilities of various parts failing under use. Further, my system and apparatus has a performance dependability that is extremely reliable in contrast to the devices and processes of the prior art. By the use of the electric field as described I am able to develop latent images with greater clarity and precision than heretofore known in the art.

I claim:

1. A process for depositing electrostatically and magnetically responsive particulate matter on a conductive surface bearing a latent image comprising:

a. producing a magnetic field having a region of concentrated magnetic flux that permeates said conductive surface and a region of dilute magnetic flux that is inclined and generally adjacent to said conductive surface;

b. said concentrated flux also permeating a slot outlet disposed at the bottom of a hopper for said particulate matter and said dilute magnetic flux permeating an upper portion of said hopper;

c. introducing a quantity of said particulate matter into said hopper to said region of dilute magnetic flux; whereby the particulate matter is retained at said outlet by said concentrated magnetic flux; and, d. placing said conductive surface into said region of concentrated magnetic flux whereby said particulate matter is caused to move from said region of dilute magnetic flux to said region of concentrated magnetic flux by the forces of magnetism and gravity and thence to said conductive surface by electrostatic forces.

2. The process of claim 1 including producing an electric field at said region of concentrated magnetic flux.

3. A process for depositing electrostatically and magnetically responsive particulate matter on a moving conductive surface bearing a latent image comprising:

a. producing a magnetic field having a region of concentrated magnetic flux that permeates the moving conductive surface and a region of dilute magnetic flux that is inclined and generally adjacent to said moving surface;

b. said concentrated flux also permeating a slot outlet disposed at the bottom of a hopper for said particulate matter and said dilute magnetic flux permeating an upper portion of said hopper;

c. introducing a quantity of said particulate matter into said hopper to said region of dilute magnetic flux whereby the particulate matter is retained at said outlet by said concentrated magnetic flux;

d. passing said conductive surface through said region of concentrated flux whereby said particulate matter is caused to move from said region of dilute magnetic flux by magnetic forces and gravitational forces to region of concentrated magnetic flux and then to said surface by electrostatic forces.

4. The process of claim 3 including producing an electric field in said region of concentrated magnetic flux to impose an electrical charge to said particulate matter and to neutralize unwanted electrical charges from said conductive surface.

* * * * *